US006830541B2

(12) United States Patent
Wu

(10) Patent No.: US 6,830,541 B2
(45) Date of Patent: Dec. 14, 2004

(54) TREADMILL WITH A MOVABLE SWITCH MOUNTED ON AN ARM THEREOF

(75) Inventor: Shen Yi Wu, Taichung Hsien (TW)

(73) Assignee: Strength Master Health Corp., Taichung Hsien (TW)

( * ) Notice: Subject to any disclaimer, the term of this patent is extended or adjusted under 35 U.S.C. 154(b) by 147 days.

(21) Appl. No.: 10/369,670

(22) Filed: Feb. 21, 2003

(65) Prior Publication Data

US 2004/0166995 A1 Aug. 26, 2004

(51) Int. Cl.[7] ..... A63B 23/06; H01H 3/16
(52) U.S. Cl. ..... 482/54; 200/61.58
(58) Field of Search ..... 482/51, 54, 1–9; 200/61.58, 43.04

(56) References Cited

U.S. PATENT DOCUMENTS 4,563,552 A * 1/1986 Fushimoto ..... 200/17 R
4,614,848 A * 9/1986 Schulte et al. ..... 200/61.85
4,771,148 A * 9/1988 Bersonnet ..... 200/61.58 R
5,034,576 A * 7/1991 Dalebout et al. ..... 200/43.04

* cited by examiner

*Primary Examiner*—Stephen R. Crow
(74) *Attorney, Agent, or Firm*—Rosenberg, Klein & Lee

(57) ABSTRACT

A treadmill includes a main frame including two opposite sides each having an arm extending from the main frame. A platform is mounted on the main frame. An endless strap is movably mounted surrounding the platform. A computer is mounted on the main frame for showing data of the treadmill. At least one movable switch is mounted on the arm of the main frame and includes a holder secured on the arm. The holder has two electrode plates mounted therein and opposite to each other. The two electrode plates are respectively electrically connected to the computer. A rotor is movably and partially mounted in the holder and has a convex electrode plate attached to a bottom of the rotor and electrically connected to the computer. The convex electrode plate is selectively contacted to the two electrode plates of the holder.

6 Claims, 8 Drawing Sheets

TREADMILL WITH A MOVABLE SWITCH MOUNTED ON AN ARM THEREOF

BACKGROUND OF THE INVENTION

1. Field of the Invention

The present invention relates to a treadmill, and more particularly to a treadmill with a movable switch mounted on an arm thereof.

2. Description of Related Art

A conventional treadmill in accordance with the prior art shown in FIG. 9 comprises a base member (5), a platform (6) mounted on the base member (5) and having a belt (61) that is driven by a motor (not shown) and movable relative to the platform (6). The base member (5) includes two opposite sides each having a stand (51) upwardly mounted on the base member (5). Each stand (51) has am arm (52) laterally extending from the top portion of the stand (51) toward a rear end of the treadmill. A computer (53) is mounted between the two arms (52) and includes multiple keys (531) for user to control the treadmill.

The computer (53) is away from the user because the computer (53) is mounted between the two arms (52) and the user runs on the platform (6). Consequently, the user needs to bend his back down to drive the computer (53) during exercising. However, the user is in a harmony posture during exercising. The user is in a movement when exercising and to press the keys (531) in the computer (53) will break the balance of the harmony posture such that the user easily falls down when operating the computer to adjust the speed or other functions of the treadmill by using the keys (531) in the computer (53).

For solving the above problem, a key-switch (54) is provided to be mounted on the arm (52) and has multiple keys (541) mounted in the key-switch (54) such that the key-switch (54) is closer to the user than the computer to the user for a convenient operation to the treadmill. However, the user still needs to press the keys (541). The above problem is not completely solved.

With reference to FIG. 10, another treadmill is provided to solving the above problem. The treadmill includes two opposite sides each having a stick (7) with a first end pivotally connected to the main frame (not numbered). A handle (71) is attached to a second end of each of the stick (7). Multiple keys (711) are mounted in each of the handle (71) for user to control the treadmill, such as the speed of the treadmill and the gradient of the platform of the treadmill.

However, the user must hold the handle (71) before controlling the treadmill. The user naturally wiggles arms during exercising on the treadmill. To hold the handle (71) will break the balance such that the user may run in a strange posture and make the user easily falls down.

As described above, a light perception switch and a contact switch are considered to be used on the treadmill for user to control the treadmill. However, the light perception switch may be influenced due to the brightness environment such that the light perception switch will become not sharp when used in a dim environment. The contact switch usually includes at least metal plate provide for user to touch thereon. However, a running treadmill easily occurs static such that a short is formed between the user's hand and the metal plate of the contact switch and the user will feel stabbing.

The present invention has arisen to mitigate and/or obviate the disadvantages of the conventional treadmills.

SUMMARY OF THE INVENTION

The main objective of the present invention is to provide an improved treadmill.

To achieve the objective, the treadmill in accordance with the present invention comprises a main frame including two opposite sides each having an arm extending from the main frame. A platform is mounted on the main frame. An endless strap is movably mounted surrounding the platform. A computer is mounted on the main frame for showing data of the treadmill. At least one movable switch is mounted on the arm of the main frame and includes a holder secured on the arm. The holder has two electrode plates mounted therein and opposite to each other. The two electrode plates are respectively electrically connected to the computer. A rotor is movably and partially mounted in the holder and has a convex electrode plate attached to a bottom of the rotor and electrically connected to the computer. The convex electrode plate is selectively-contacted to the two electrode plates of the holder.

Further benefits and advantages of the present invention will become apparent after a careful reading of the detailed description with appropriate reference to the accompanying drawings.

DETAILED DESCRIPTION OF THE INVENTION

Figure 1:
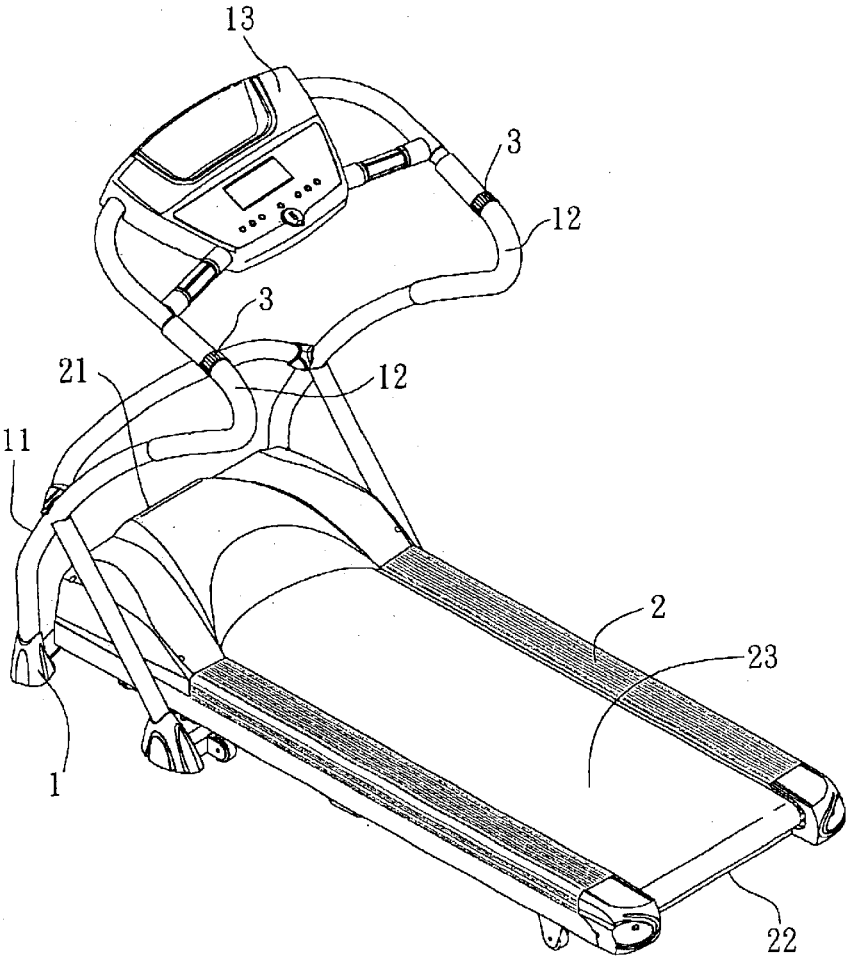
FIG. 1 is a perspective view of a treadmill with a movable switch in accordance with the present invention.
Figure 2:
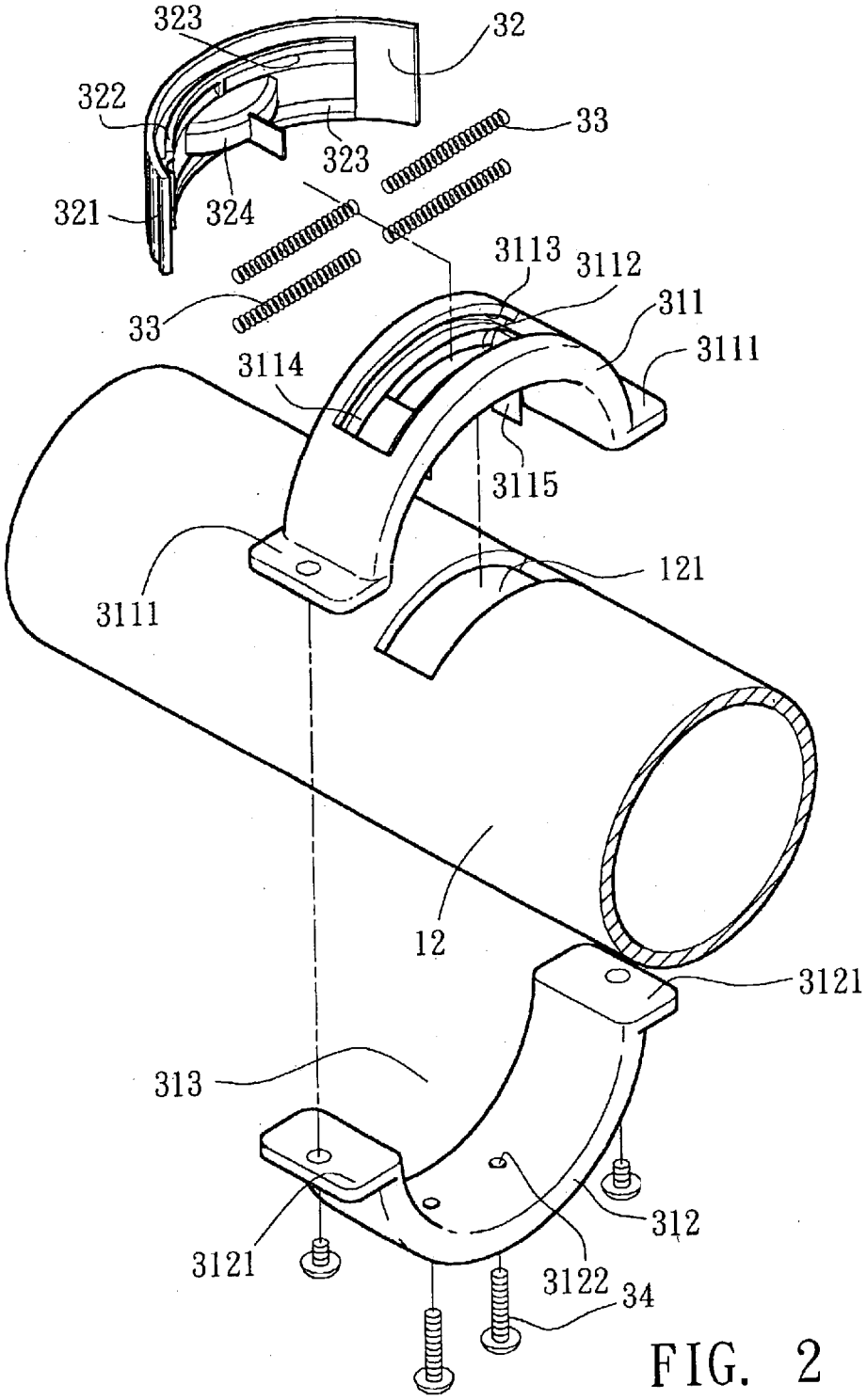
FIG. 2 is an exploded perspective view of the movable switch of the treadmill as shown in FIG. 1.
Figure 4:
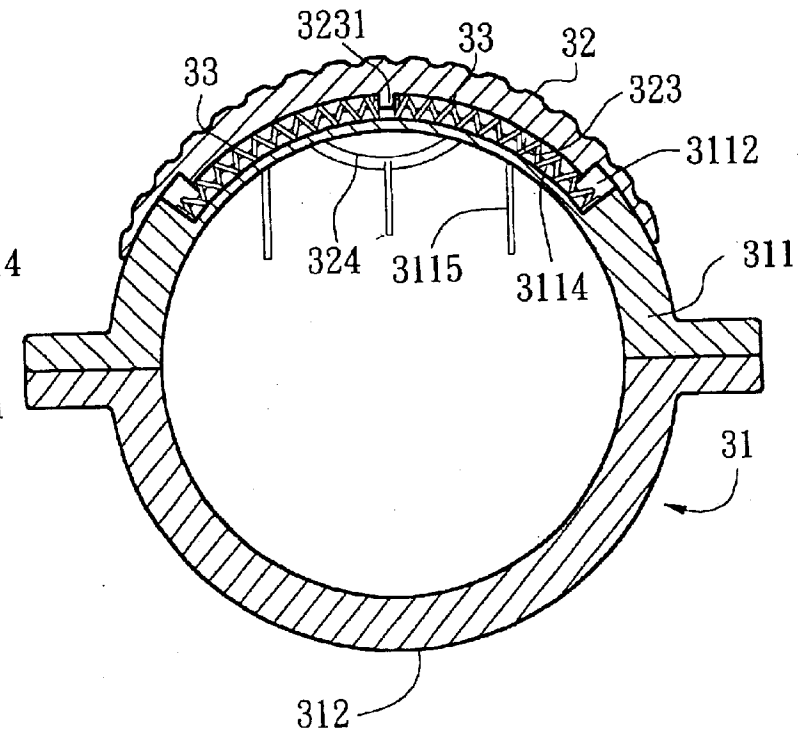
FIG. 4 is a rear cross sectional view of the movable switch in FIG. 2.
Figure 3:
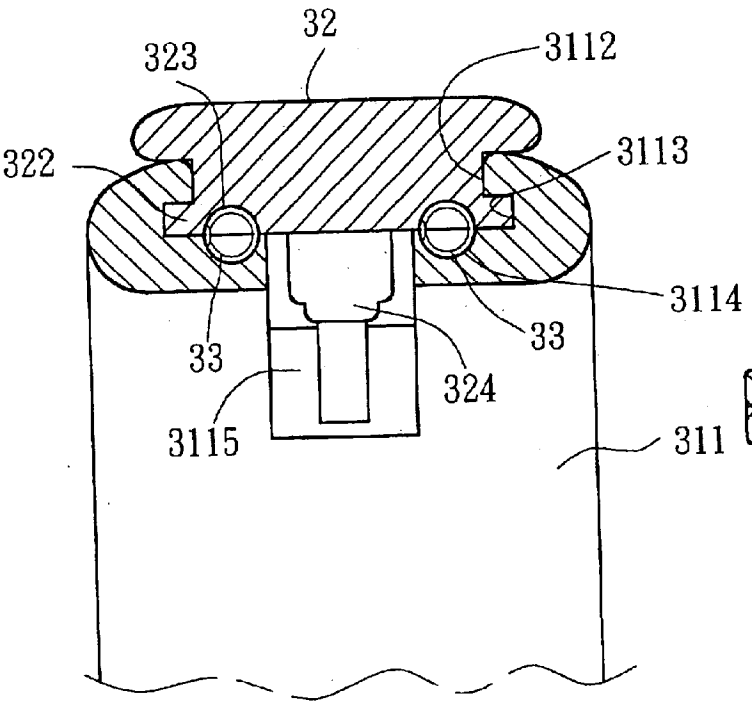
FIG. 3 is a side cross sectional view of the movable switch in FIG. 2.
Figure 5:
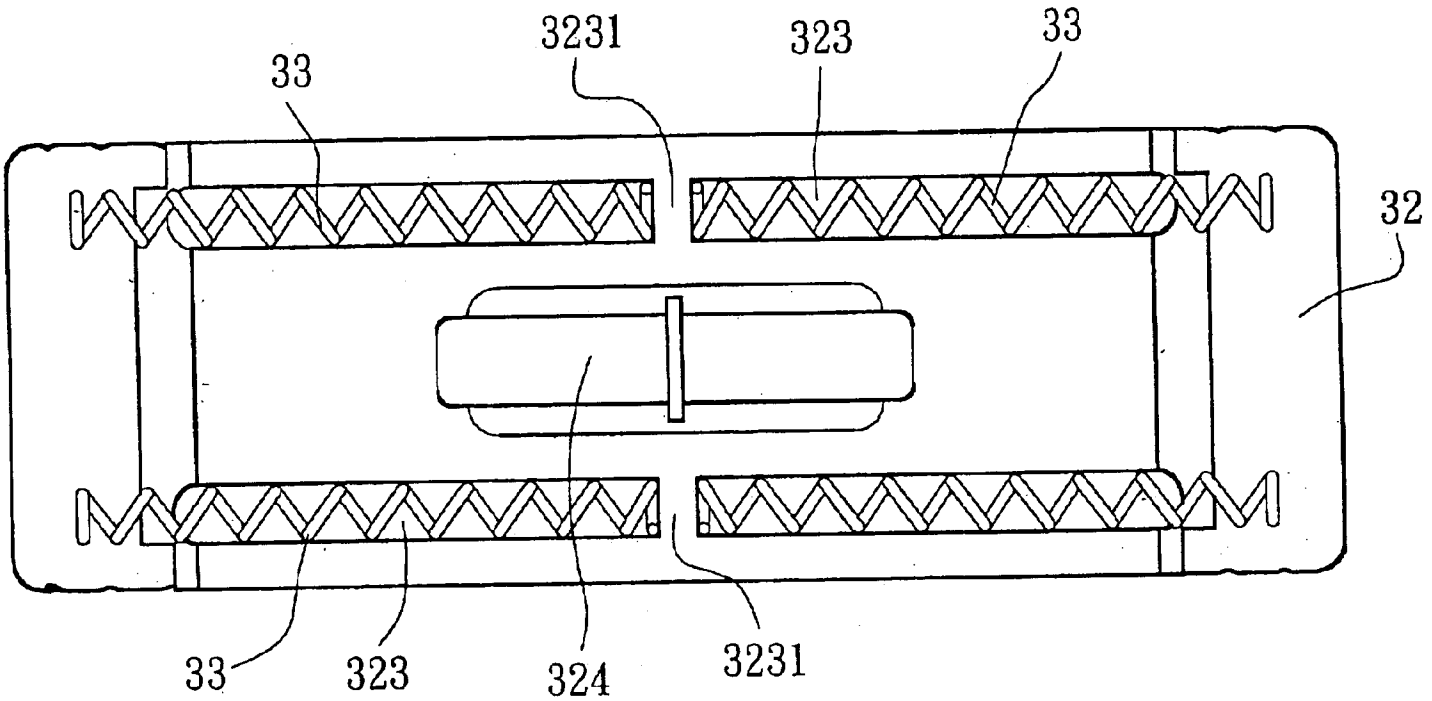
FIG. 5 is a bottom plan view of a rotor of the movable switch in FIG. 2.

Referring to the drawings and initially to FIGS. 1–5, a treadmill with a rotatable switch in accordance with the present invention comprises a main frame (1), a platform (2) mounted on the main frame (21) and at least one movable switch (3) mounted on the main frame (1) for user to control the treadmill of the present invention.

The main frame (1) includes two opposite sides each having a stand (11) upwardly extending from the main frame (1). An arm (12) laterally extends from a free end of each of the two stands (11) for supporting with the hands of the user and has an opening (121) defined in the arm (12). A computer (13) is mounted on the main frame (1) between the two arms (12). The computer (13) has a CPU mounted therein for executing the functions of the treadmill.

The platform (2) has a front portion (21) between the two stands (11) of the main frame (1) and a rear portion (22)

opposite to the front portion (21) of the platform (2). The arms (12) of the main frame (1) extend toward the rear portion (22) of the platform (2). An endless strap (23) is mounted surrounding the platform (2) and is movable relative to the platform (2) for user to exercise thereon. The endless strap (23) is driven by a power source (not shown) that is mounted on the main frame (1) near the front portion (21) of the platform (2).

In the preferred embodiment of the present invention, the treadmill in accordance with the present invention includes two movable switches (3) each mounted on a corresponding one of the two arms (12) of the main frame (1). The movable stitch (3) includes a holder (31) secured on the arm (11), a rotor (32) movably and partially mounted in the holder (31) and multiple resilient members (33) received in the holder (31) to provide a restitution force to the rotor (32).

The holder (31) includes an upper semicircular connector (311) and a lower semicircular connector (312) abutting each other to form a passage (313) to allow the arm (12) extending through the movable switch (3). The upper and lower semicircular connectors (311, 312) each includes two opposite ends each having an ear (3111, 3121) laterally outwardly extending from a corresponding one of the two semicircular connectors (311, 312). The ears (3111) of the upper circular connector (311) and the ears (3121) of the lower semicircular connector (312) are secured on each other. The lower semicircular connector (312) has at least one threaded hole (3122) defined therein and extending therethrough. At least one bolt (34) is screwed into the threaded hole (3122) and securely abutting an outer periphery of the arm (12) to hold the movable switch in place. A groove (3112) is defined in and extending through the upper semicircular connector (311) alone the shape of the upper semicircular connector (311), and corresponds to the opening (121) in the arm (12). The upper semicircular connector (311) includes two slits (3113) each laterally defined in a corresponding one of two opposite sidewalls of the groove (3112), and two lower slots (3114) defined in a bottom of the groove (3112) and parallel to each other. Two electrode plates (3115) each is secured on a corresponding one of two opposite ends of the groove (3112). The electrode plate (3115) has a free end extending into the arm (12) via the opening (121) and electrically connected to the CPU in the computer (13).

The rotor (32) has a circular shape corresponding to that of the upper semicircular connector (311). The rotor (32) has a series of notches (321) defined in a first side thereof and two flanges (322) laterally extending from a bottom of the rotor (32). Each flange (322) is slidably received in a corresponding one of the two slits (3113) in the upper semicircular connector (311) such that the rotor (32) is slidable relative to the upper semicircular connector (311). The rotor (32) includes two upper slots (323) defined in a second side of the rotor (32) and each aligning with a corresponding one of the lower slots (3114) in the upper semicircular connector (311). Two stoppers (3231) are formed on the second side of the rotor (32) and each extends into a corresponding one of the upper slots (323) to centrally divide the two upper slots (323) into a first section and a second section. A convex electrode plate (324) is centrally attached to the second side of the rotor (32). The convex electrode plate (324) partially extends into the arm (12) and electrically connected to the CPU in the computer (13) via the groove (3112) in the upper semicircular connector (311) and the opening (121) in the arm (12). The convex electrode plate (324) is selectively contacted to the electrode plates (3115) of the upper semicircular connector (311) when the rotor (32) is moved along the upper semicircular connector (311).

The resilient members (33) are compressively received between the first sections of the two upper slots (323) and the lower slots (3114), and the second sections of the two upper slots (323) and the lower slots (3114). In the preferred embodiment of the present invention, the resilient members (33) are springs. The stopper (3231) will compress the resilient members (33) when the rotor (32) is moved alone the upper semicircular connector (311) for providing a restitution force to the rotor (32).

Figure 6:
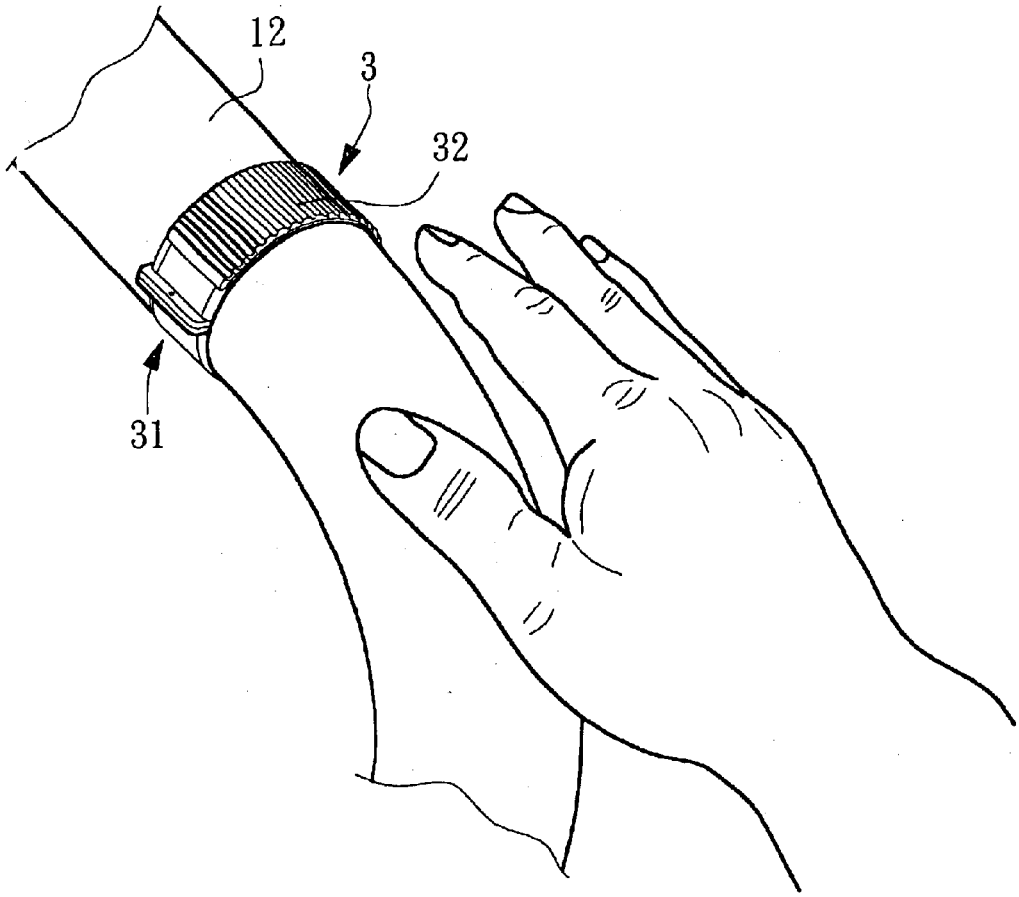
FIG. 6 is perspective schematic view of the movable switch in FIG. 2.
Figure 7:
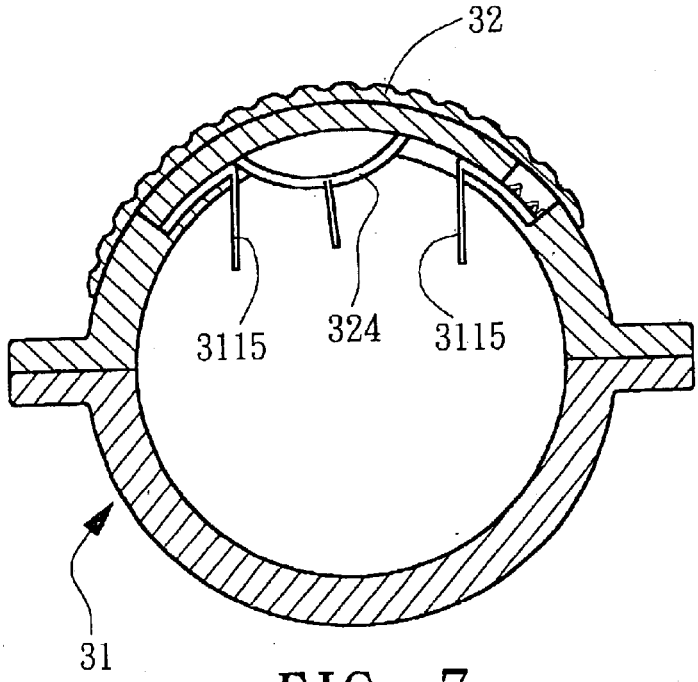
FIG. 7 is a rear operational plan view in cross section of the movable switch in FIG. 6.
Figure 8:
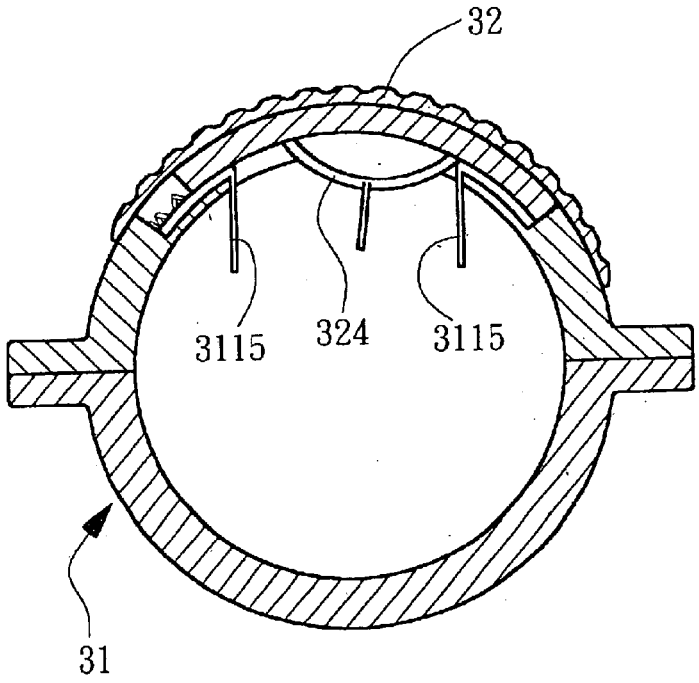
FIG. 8 is another rear operational plan view in cross section of the movable switch in FIG. 6.
Figure 9:
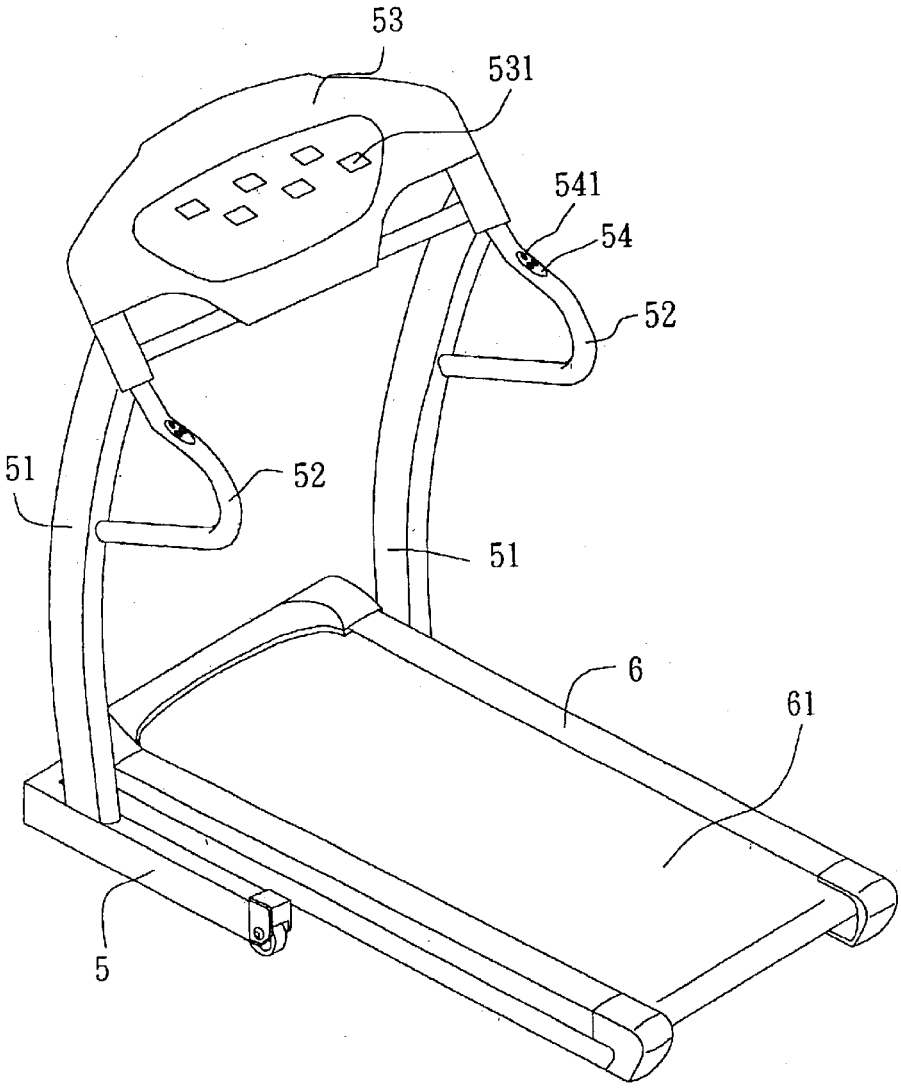
FIG. 9 PRIOR ART
FIG. 9 is a perspective view of a conventional treadmill in accordance with the prior art.
Figure 10:
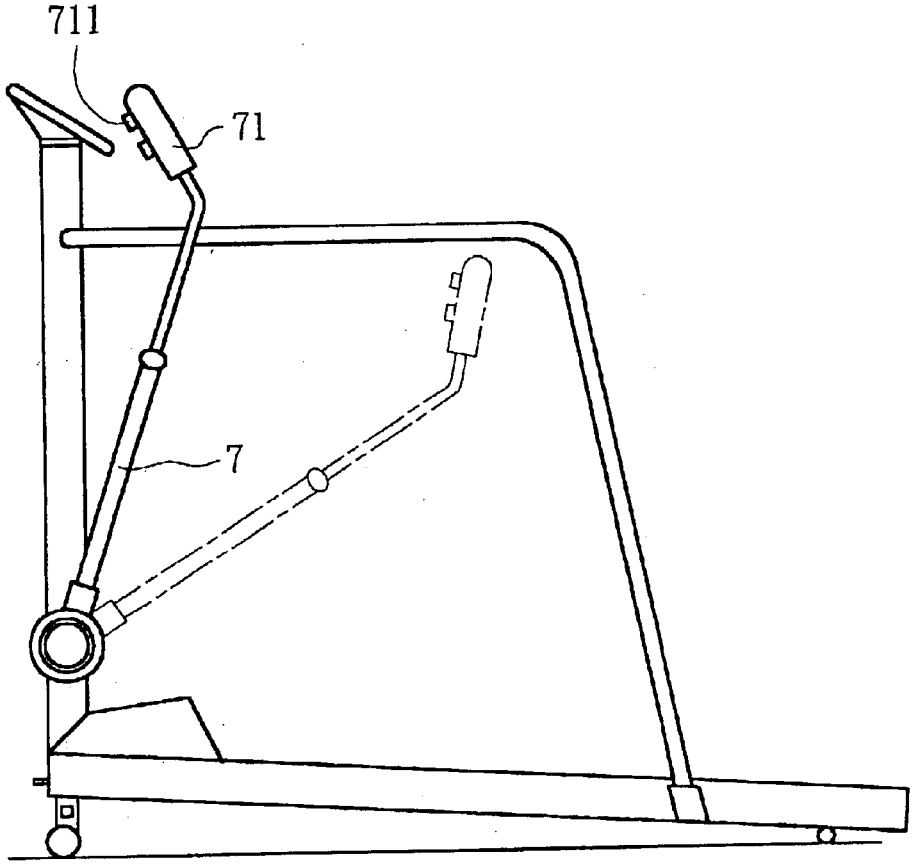
FIG. 10 PRIOR ART
FIG. 10 is a side plan view of another conventional treadmill in accordance with the prior art.

With reference to FIGS. 6, 7 and 8, the user only needs to rotate the rotor (32) leftward or rightward to make the electrode plate (324) of the rotor (32) contacting with the electrode plate (3115) in the holder (31) to adjust the speed of the treadmill. In the preferred embodiment of the present invention, the two arms (12) each has a movable switch (3) mounted thereon such that one is provided for speed up and the other for retarding or any other functions of the treadmill.

The rotor (32) is disposed along the outer periphery of he holder (31) such that the rotor (32) has an enlarged contact area for the user to easily touch and rotatably operate the movable switch (3). Consequently, the user does not need to bend down for touching the keys on the computer of a treadmill. Furthermore, the treadmill in accordance with the present invention has arisen to mitigate and/or obviate the disadvantages of the conventional treadmills that use a light perception switch or a contact switch to control the functions of the conventional treadmill.

Although the invention has been explained in relation to its preferred embodiment, it is to be understood that many other possible modifications and variations can be made without departing from the spirit and scope of the invention as hereinafter claimed.

What is claimed is:

1. A treadmill with a movable switch mounted on an arm thereof, comprising:

a main frame including two opposite sides each having an arm extending from the main frame;

a platform mounted on the main frame;

an endless strap mounted surrounding the platform and movable relative to the platform for user to exercise on the endless strap;

a computer mounted on the main frame for showing data of the treadmill; and at least one movable switch mounted on a corresponding one of the arms of the main frame, the at least one movable switch including:

a holder secured on a corresponding one of the arms of the main frame, and having two electrode plates mounted in the holder and opposite to each other, the two electrode plates respectively electrically connected to the computer; and a rotor movably and partially mounted in the holder, the rotor having a convex electrode plate attached to a bottom of the rotor and electrically connected to the computer of the treadmill, the convex electrode plate selectively contacted to the two electrode plates of the holder.

2. The treadmill as claimed in claim 1, wherein the two opposite sides of the main frame each has a stand upwardly extending from the main frame, and the arms extends respectively from a corresponding one of the two stands of the main frame.

3. The treadmill as claimed in claim 2, wherein:

the holder comprises an upper semicircular connector and a lower semicircular connector abutting each other to form a passage allowing the arm extending through the movable switch, a groove defined in and extending through the upper semicircular connector, two slits each laterally defined in a corresponding one of two opposite sidewalls of the groove and two lower slots defined in a bottom of the groove and parallel to each other, the two electrode plates of the upper connector respectively secured on a corresponding one of two opposite ends of the groove;

the rotor has two flanges respectively laterally extending from a bottom of the rotor, each flange slidably received in a corresponding one of the two slits in the upper semicircular such that the rotor being slidable relative the upper semicircular connector, two upper slots defined in a bottom of the rotor and each aligning with a corresponding one of the two lower slots in the holder, two stoppers formed on the bottom of the rotor and each extending into a corresponding one of the two upper slots to equally divide the two upper slots into a first section and a second section; and multiple resilient members are received in the holder to provide a restitution force to the rotor, the multiple resilient members each compressively received between the first sections of each of the two upper slots and a corresponding one of the two the lower slots, and the second sections of each of the two upper sections and a corresponding one of the two lower slots.

4. The treadmill as claimed in claim 3, wherein the arm has an opening defined to correspond to the groove in the upper connector and allow the electrode plates of the upper connector partially extending into the arm.

5. The treadmill as claimed in claim 3, wherein the resilient members are springs.

6. The treadmill as claimed in claim 3, wherein the rotor has a series of notches defined in a top surface of the rotor for anti-slip when the user touched the rotor.

* * * * *